United States Patent [19]

Craig et al.

[11] 4,416,619

[45] Nov. 22, 1983

[54] POROUS CERAMIC COMBUSTION REACTOR

[75] Inventors: Laurence B. Craig, Glen Cove; Alfred J. Farina, Baldwin, both of N.Y.

[73] Assignee: Thermocatalytic Corp., Williston Park, N.Y.

[21] Appl. No.: 294,463

[22] Filed: Aug. 20, 1981

[51] Int. Cl.[3] ..... F23D 13/12

[52] U.S. Cl. ..... 431/328

[58] Field of Search ..... 431/328, 329; 126/92 B

[56] References Cited

U.S. PATENT DOCUMENTS

| | | | |
|---|---|---|---|
| 3,179,156 | 4/1965 | Weiss et al. | 431/329 |
| 3,208,247 | 9/1965 | Weil et al. | 431/328 |
| 3,216,478 | 11/1965 | Saunders et al. | 431/329 |
| 3,954,387 | 5/1976 | Cooper | 431/328 |

FOREIGN PATENT DOCUMENTS

| | | | |
|---|---|---|---|
| 1455790 | 9/1966 | France | 431/328 |

*Primary Examiner*—Carroll B. Dority, Jr.
*Attorney, Agent, or Firm*—Bauer & Amer

[57] ABSTRACT

There is described a porous ceramic reactor which is used in a heating system. The combustion of fuel occurs on the outer surface of the reactor. The outer surface has a plurality of indentations that break up the surface continuity. As a consequence, the scaling and cracking that occurs due to differential expansion and contraction is minimized. Alternatively, the surface continuity can be broken up by means of a wide mesh metal screen that is in contact with the surface thereby creating thermal continuities that minimize scaling.

1 Claim, 5 Drawing Figures

POROUS CERAMIC COMBUSTION REACTOR

BACKGROUND OF THE INVENTION

This invention relates to a porous ceramic combustion reactor used in combustion heating systems and more particularly to an outer surface design for a hollow porous ceramic reactor.

Gas fired porous ceramic reactors for generating an intense heat have been known and used for an appreciable period of time. A radiant gas burner incorporating such a reactor is described in the U.S. Pat. No. 3,191,659, issued June 29, 1965. Another is described in connection with a space heater in U.S. Pat. No. 3,179,156, issued Apr. 20, 1965. Characteristically, such reactors in operation exhibit an outer surface temperature of between 925° C. to 1000° C. These reactors are generally tubular and may have an inner surface temperature of about 65° C. These reactors are ceramic and have low thermal conductivity. This low thermal conductivity in combination with the cooling effect of the flow of the gas and air mixture through the reactor from the interior outward, results in a concentration of heat in a thin outer surface layer about 0.5 mm thick. The elevated temperature of this surface layer causes it to shrink up to four percent (4%). The underlying material, not being nearly so hot, does not shrink measurably. Thus, the underlying material cannot accommodate to the surface shrinkage and as a result cracks appear on the surface. These cracks tend to appear as lines along a circumference. That is the crack lines are in planes that are substantially at right angles to the axis of the reactor. These cracks vary in depth and interval and often result in the scaling of the surface of the reactor.

Accordingly, it is a purpose of this invention to provide a ceramic reactor which can stand up to this differential temperature without substantial scaling.

BRIEF DESCRIPTION

In brief, one embodiment of the ceramic reactor of this invention has a surface which has been molded, and then fired, in a fashion that provides a series of linear indentations arranged in the form of a grid. This grid like arrangement of indentations interrupts the stress lines created by the high thermal gradient at the surface. As a consequence, the surface is less prone to the cracking, scaling and spalling damage that occurs due to the thermal gradient induced stress.

BRIEF DESCRIPTION OF THE FIGURES

In FIG. 1, the magnitude of the indentations is exaggerated in order to illustrate the concept.

DESCRIPTION OF THE PREFERRED EMBODIMENTS

Figure 1:
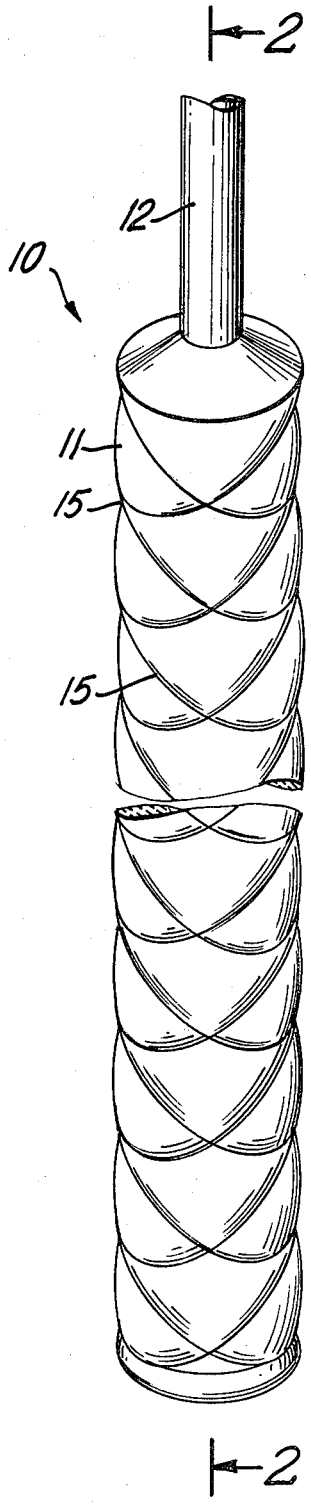
FIG. 1 is a perspective view of one embodiment of the device of this invention indicating a series of crisscrossing indentations.
Figure 2:
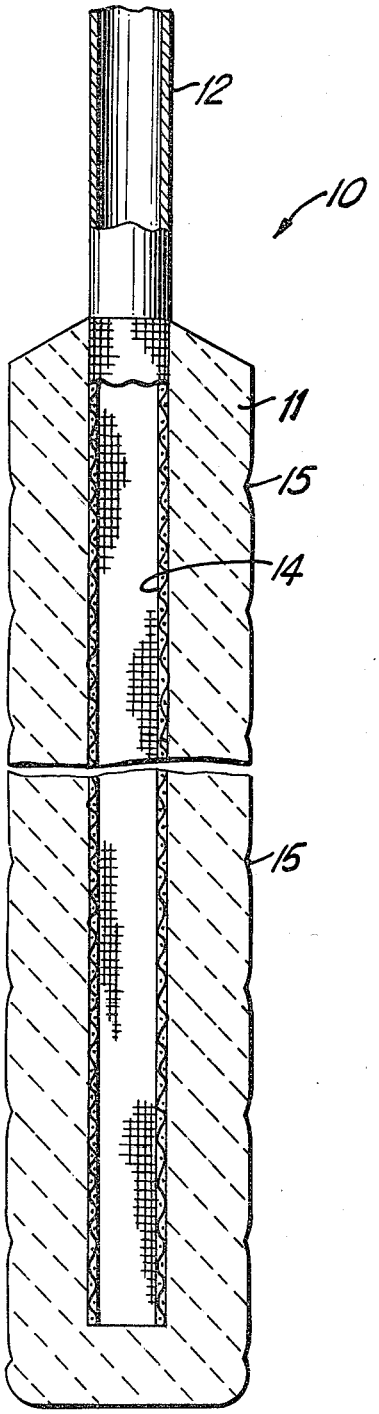
FIG. 2 is a longitudinal cross-sectional view of FIG. 1 illustrating the essentially tubular nature of the reactor.
Figure 3:
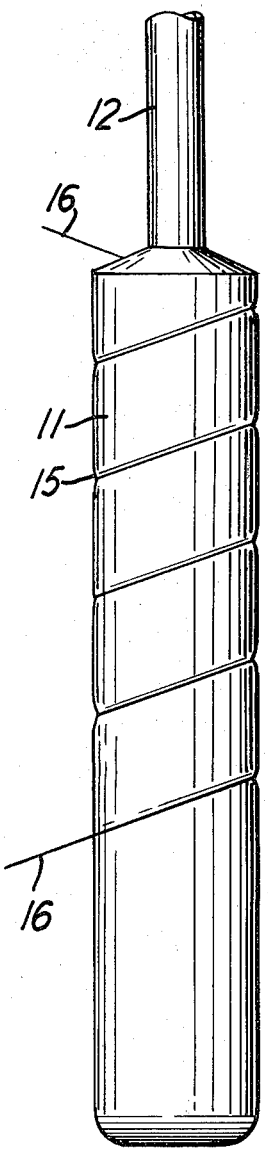
FIG. 3 illustrates an intermediate stage in the preparation of the ceramic material that is to be fired to provide the FIG. 1 reactor.
Figure 4:
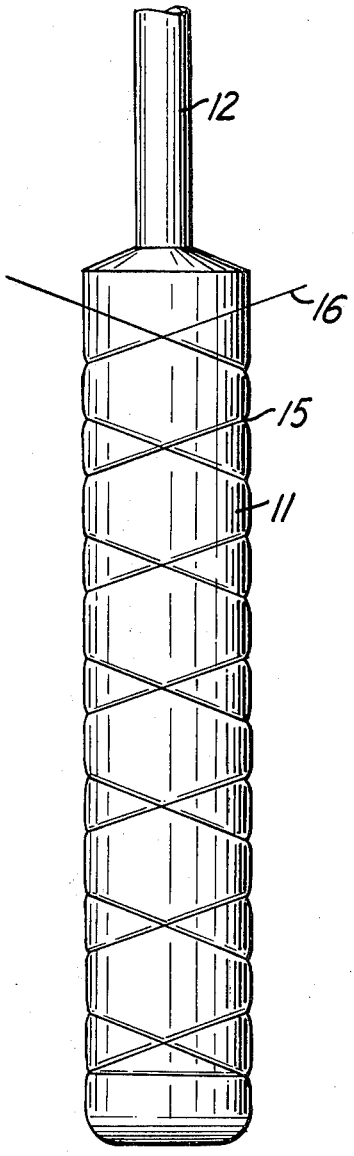
FIG. 4 represents a further intermediate stage that is more advanced than the stage shown in FIG. 3. The technique shown in FIGS. 3 and 4 employs a string to effect the indentations.

The ceramic reactor 10 of this invention may be any one of a number of known types of material used in radiant gas burners that incorporate these reactors. One such material is described in U.S. Pat. No. 3,275,497. As illustrated, in FIGS. 1 and 2, the reactor 10 is typically a tubular cylinder and, for example, may have a length of 25 cm., an outside diameter of 3.0 cm., an inside diameter of 1.5 cm., and therefore a wall thickness of 0.75 cm. A combustible fuel, such as natural gas mixed with air, is admitted through the inlet tube 12 and passes into the interior chamber within this ceramic reactor 10. This fuel then passes through a cylindrical screen 14 which lines that chamber and thence into the ceramic material of the reactor. This ceramic material is porous enough to permit the fuel gas to pass through the wall of the reactor. The fuel-air mixture is ignited to burn along the outside surface of the reactor. The ceramic reactor 10 acts to assure continuous even burning of the fuel along the entire surface of the reactor 10 causing the reactor to incandesce thereby radiating a substantial amount of heat.

The result of this operation is that the outer surface of the reactor may have a temperature of 1000° C. which drops to an inner surface temperature of about 65° C. But the temperature drop is greatest near the surface and in particular over a very thin layer of about 0.5 mm. The differential shrinking at the surface causes a surface layer to develop cracks. As these cracks increase and cover the surface, a surface scale develops and falls off. This loss of reactor material tends to reduce the effectiveness and efficiency of the operation of the reactor and over a period of time after much scaling, can cause uneven combustion and ultimately the breakage of the reactor surface.

What has been found is that if the surface of the reactor can be broken up in a thermal sense into individual areas or parcels, the limited surface area of each parcel does not expand or contract enough to cause a crack. Should a crack develop nevertheless, its extent is limited by the boundary of the individual parcel.

Indeed, it has been noticed that the surface cracks due to differential expansion and contraction tend to occur in circumferential lines. Accordingly, surface lines with linear thermal breaks having a longitudinal component has been found to be useful in that the extent of the thermal stress is reduced.

More particularly, as shown in FIGS. 1 through 4, it has been found useful to provide a reactor having a series of surface indentations 15. This is brought about during the fabrication of the reactor. The ceramic material, in an uncured state, is placed on the inlet tube 12 ready to be fired. Before firing, an ordinary burnable fabric string 16 is wrapped around the uncured ceramic in the fashion shown in FIGS. 3 and 4 to provide a series of indentations. During the firing of the ceramic material, the string 16 simply burns away. However, because of the string 16 the linear zones immediately under the strings are indented and are probably made somewhat more dense than the rest of the surface of the reactor. As a consequence, when a crack occurs along the surface during the operation of the reactor, it will be interrupted after a short distance by one of these indented, denser zones 15 which have been created by the string 16.

The figures greatly exaggerate the degree of indentation effected by wrapping the string on the surface of the uncured ceramic in order to illustrate the nature of the design. In fact, the indentations 15 are only about 0.5 mm.

Figure 5:
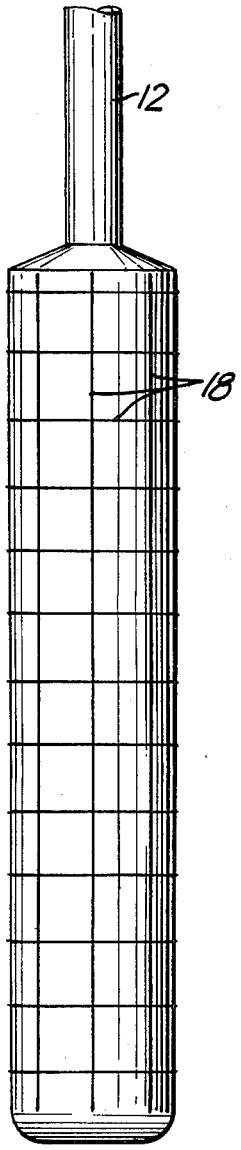
FIG. 5 illustrates a second embodiment of the invention in which a wide mesh metal screen on the reactor surface creates lines of decreased surface temperature to provide the desired interruption of the thermal stress lines.

As shown in FIG. 5, a different approach can be taken in creating these thermal discontinuities along the surface of the reactor. A wide mesh screen 18 is wrapped around the reactor after it has been cured. The contact between the screen elements and the surface of the reactor results in a reduction in the temperature of the surface of the reactor in the linear zones immediately under the screen wires and thus provides a series of thermal discontinuities along the surface of the reactor. When the reactor surface tends to crack during differential expansion and contraction in use, the cracks are stopped by the thermal discontinuities and thus the amount of scaling is greatly reduced.

In one embodiment, the string 16 is wound to provide a pitch between parallel segments of about 0.5 to one centimeter. In another embodiment, the screen 8 is a stainless steel screen having a mesh distance of about three millimeters.

In one embodiment the string used was common cotton sewing thread having a diameter of about 0.125 mm. A continuity between indentations 15 is preferred to parcellize the surface. However, the indentation 15, as well as the discontinuities 18, are referred to herein in the plural. This is because the linear network would normally be seen as a set of line segments. It should be understood herein that in the claims and in the specification, the use of the terms "indentations" and "discontinuities" shall be understood to include but shall not be limited to, a single continuous linear tracing.

What we claim is:

1. A porous ceramic reactor for use in a heating system, said reactor being tubular and having an outer surface at which combustion occurs, said outer surface having indentations to break up the surface continuity in the form of at least two spirals of opposing twist, providing a lozenge pattern, extending continuously along the length thereof.

* * * * *